United States Patent [19]

Arnold et al.

[11] Patent Number: 5,016,228

[45] Date of Patent: May 14, 1991

[54] SONAR TRANSDUCERS

[75] Inventors: Douglas B. Arnold, Portland; George Bromfield, Martinstown; John C. Gardner, Bowden, all of England

[73] Assignee: The Secretary of State for Defence in Her Britannic Majesty's Government of the United Kingdom of Great Britain and Northern Ireland, London, Great Britain

[21] Appl. No.: 276,196

[22] Filed: Nov. 21, 1988

Related U.S. Application Data

[63] Continuation of Ser. No. 188, Mar. 18, 1987.

[30] Foreign Application Priority Data

| | | | |
|---|---|---|---|
| Mar. 19, 1986 | [GB] | United Kingdom | 8606744 |
| Mar. 19, 1986 | [GB] | United Kingdom | 8606745 |
| Mar. 19, 1986 | [GB] | United Kingdom | 8606746 |
| Mar. 19, 1986 | [GB] | United Kingdom | 8606747 |

[51] Int. Cl.[5] ..... H04R 17/00

[52] U.S. Cl. ..... 367/163; 367/167; 367/174; 310/337

[58] Field of Search ..... 367/157, 163, 167, 172, 367/174; 310/337

[56] References Cited

U.S. PATENT DOCUMENTS

| | | | |
|---|---|---|---|
| 2,966,656 | 12/1960 | Bigbie et al. | 367/158 |
| 3,274,537 | 9/1966 | Toulis | 367/163 |
| 4,287,582 | 9/1981 | Tocquet | 367/163 |
| 4,420,826 | 12/1983 | Marshall, Jr. et al. | 367/159 |
| 4,764,907 | 8/1988 | Dahlstrom et al. | 367/163 |
| 4,845,687 | 7/1989 | Bromfield | 367/158 |

FOREIGN PATENT DOCUMENTS 0215657 3/1986 European Pat. Off.

OTHER PUBLICATIONS

Navy Technical Disclosure Bulletin, vol. 4, No. 8, Aug. 1979; Office of Naval Research, (Arlington, VA, USA), J. A. Pagliarini, Jr.; pp. 1-4.

*Primary Examiner*—Stephen C. Bentley
*Assistant Examiner*—J. Woodrow Eldred
*Attorney, Agent, or Firm*—Nixon & Vanderhye

[57] ABSTRACT

A high power, low frequency flextensional transducer for underwater use comprises a number of spaced piezoelectric element stacks between opposed inserts. The stacks are placed on the plane through the major axis of an elliptical flexural shell and the inserts are shaped to conform with the elliptical shape. The stacks are assembled with first tapered supports and complementary tapered slides are wedged between the shell inserts and the tapered supports until a required pre-stress is exerted by the shell on the piezo-electrical stacks. End-plates are attached to the elliptical shell to complete the transducer; the shell having a compression bonded layer of neoprene applied, including a peripheral serrated lip seal to seal against the end-plate while permitting flexing of the shell. A means to provide wide band-width performance is also disclosed. To extend the range of operational depths the cavity within the transducer is filled with a gas whose vapour pressure can be temperature-controlled.

25 Claims, 7 Drawing Sheets

SONAR TRANSDUCERS

BACKGROUND OF THE INVENTION

1. Field of the Invention

The invention relates to sonar transducers and in particular to elliptical shell flextensional transducers.

2. Discussion of the Prior Art

Flextensional transducers are used to generate and radiate high power acoustic energy at low frequencies, typically in the range 200–800 Hz.

The construction of an elliptical shell transducer comprises a shell of an elliptical cylindrical form into which a piezo-electric stack or stacks is fitted along the major axis. These stacks consist of a number of piezo electric plates between which are sandwiched metal electrodes; these in turn being electrically connected in parallel. The ends of the shell are closed by end plates which are retained against the ends of the shell by tie bars.

When an alternating voltage is applied to the electrodes a vibration is generated along the major axis of the stack, this being transmitted into the shell, which due to its shape, increases the amplitude on the minor axis of the shell.

The normal method of assembling an elliptical shell flextensional transducer is by applying a load on the minor axis of the shell by means of a press of suitable size to cause an extension of the major axis such that the piezo-electric stack may be inserted, the final adjustments being made by the fitment of shims between the ends of the stack and the inner wall of the shell. This necessitates a relatively large working clearance to allow for fitting the shims.

When the load is removed from the minor axis, the major axis reduces in length and hence a stress is applied to the stack due to the action of the shell.

The major disadvantages of this type of assembly are:

1. the clearances required for assembly do not allow for the maximum advantage to be gained from the strain energy stored within the shell after loading; and
2. there is difficulty in maintaining a uniform stress on the piezo electric stack without a very high standard of engineering and quality control, since very small differences in wall thickness of the shell causes asymmetic loading of the stack.

When designing an elliptical shell flextensional transducer it is essential to stress the piezo electric stack to a precise value, since when it is deployed into water the increasing hydrostatic pressure with depth progressively reduces the stress on the piezo-electric stack and hence a limit is reached beyond which the transducer cannot be driven without damage.

Flextensional transducers are normally sealed by means of end plates, however because they are capable of high power operation and thus the large amplitude flexing of the elliptical shell which occurs creates difficulties in water-tight sealing between the shell and end-plates since the sealing must be effective without limiting shell movement.

In order to operate there must be a pre-stress load applied by the elliptical shell to the transducer stacks. Operation over a wide range of pressure-depths requires that some form of pressure-balancing arrangements is provided.

Conventional pressure compensation or balancing systems have a number of operational disadvantages.

The most common types of pressure balancing systems are air filled bladders and scuba type systems of which the latter use bottled compressed air coupled to a divers pressure balanced valve. The bladder method is severely limited as the volume of air in the cavity of the transducer is inversely proportional to the external hydrostatic pressure. The resulting reduction of the available swept volume for the active surface progressively lowers operating efficiency as the hydrostatic pressure is increased. The scuba system is a large and often relatively heavy appendage to a sonar transducer. In operation it can use large quantities of air if frequent changes in operating depth are required or if there are large unwanted depth excursions due to the effects of ocean swell on the deployment platform.

In a conventional design of flextensional transducer the dimensions of the shell are calculated to utilize the first and sometimes other flexural modes of vibration along the entire length of the oval cylinder. The shell has therefore a single resonance frequency and a finite bandwidth associated with each flexural mode.

SUMMARY OF THE INVENTION

The object of the present invention is to provide an elliptical shell flextensional transducer which overcomes some of the problems associated with the prior art arrangements.

The invention provides a flextensional transducer comprising:

- a hollow cylindrical flexural shell, elliptical in cross section and open at both ends;
- at least one linear stack of piezo-electric elements fitted along the major axis of the ellipse between the opposed internal walls of the shell;
- two metal inserts located one at each end of the major axis between the shell wall and the corresponding end of the transducer stack and shaped in cross section to maintain the elliptical shape of the shell; and complementary wedge-shaped portions interposed between each insert and the corresponding stack end.

The construction of the present invention allows fine adjustment of the shell tension in the flextensional transducer during assembly. This is monitored by measuring electrical charge from the piezo-electric stack.

In a preferred arrangement the abutting surfaces of each insert and the adjacent wedge-shaped portion are radiused. By this means the wedge portions self-align as they are assembled within the transducer shell, ensuring a more even distribution of stress over the piezo-electric stack in the event of any asymmetry in the elliptic shell than has been possible hitherto.

Advantageously there is provided a sealing member for sealing between the end plates and the flexural shell, the sealing member being a low shear modulus rubber vulcanised moulded to the outer surface of the flexural shell to form a continuous outer coating with integral lip seals on the end surfaces of the shell. Advantageously the rubber is neoprene rubber and is provided with a plurality of concentric elliptical serrations on the outer surface of the lip seal for contact with the respective end plate. The degree of compression is ideally between about 10% and 30% and this determines the depth of the serrations and the dimensions of the means for holding together the end plates and shell assembly. Preferably the overall thickness of the seal is determined by the peak magnitude of the shell vibration such that the sheer stress angle is limited to 30 deg. A plurality of tie bars are fixed between the two end plates and located inside or outside the shell to determine the compression of the lip seals.

In this arrangement of the invention a method of sealing end plates to a flextensional transducer includes the steps of:

(a) locating the shell on a supporting mandrel;

(b) compression moulding a low shear modulus rubber coating, for example neoprene, over the outer surface of the shell to form a lip seal integral therewith on each end of the shell;

(c) assembling end-plates to the shell and tightening tie-bars between the end plates so as to give the required compression of the end plate seals between each end plate and its respective shell end.

Advantageously the vulcanised moulding is done in a hydraulic press. During assembly of the transducer a plurality of tie-bars interconnecting the end plates are adjusted in length to achieve the desired compression of the lip seals.

Alternatively the serrated lip seal could be compression moulded to the end closure plates and the complete transducer dip-coated in liquid neoprene.

For operation over a wide range of pressure-depth preferably there is provided a pressure compensation means comprising: a cavity defined in part by the shell of the flextensional transducer; a gas contained in the cavity; means to vary the temperature of the gas; a depth pressure sensor; and a control circuit connected to the pressure sensor and the temperature varying means to control the temperature of the gas such that the gas vapour pressure acting on the inner side of the shell is substantially the same as the depth pressure.

In one arrangement the temperature varying means is a heating element.

The gas may fill the cavity or alternatively it may fill a bladder within the cavity. In a further arrangement the cavity may contain a dual bladder. The gas may fill one section of the bladder and seawater the other section, the bladder being arranged in such a way that the gas is compressed by the external ambient hydrostatic pressure.

In the preferred arrangement the gas is dichlorodifluoromethane (freon). In addition to providing pressure compensation the gas-filled transducer can operate at a higher power duty cycle or higher ambient temperature than hitherto possible. Waste heat generated in the active piezoelectric elements of the transducer is transferred away more efficiently by the dichlorodifluoromethane and other similar suitable gases than by the conventionally used air or nitrogen. Suitable gases are those which have a convenient vapour pressure temperature characteristic. Thus these transducers can operate at greater depth than similar current transducers before thermal runaway.

In order to provide broad-band operation the two inserts located one at each end of the major axis between the shell wall and the corresponding end of the transducer stack and generally "D" shaped in cross section to maintain the elliptical shape of the shell may be formed such that the arcuate length of each insert surface in contact with the shell wall-changes along the length of the shell cylinder.

In one form there may be one or more discrete length changes of the arcuate surface of each insert. By this means there are produced two or more regions along the length of the shell having differing free lengths of vibrating shell. Advantageously the shell is segmented along its length with weakened regions corresponding to the positions of changing cross section of the inserts. By this means a number of discrete fundamental flexural mode resonances can be excited by driving the piezoelectric stack assembly at these frequencies with the weakened portions assisting towards decoupling the different length portions of the shell.

In another form wherein the shell is uniform along its length the arcuate profile of each insert cross section is progressively changed along the length or part of the length of the shell.

BRIEF DESCRIPTION OF THE DRAWINGS

The invention will now be described by way of example with reference to the accompanying Figures of which.

DETAILED DISCUSSION OF THE PREFERRED EMBODIMENTS

Figure 1:
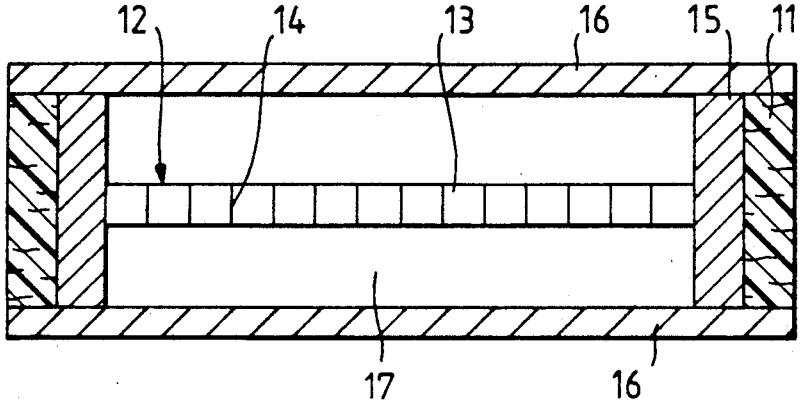
Fig. 1. PRIOR ART
FIG. 1 shows a conventional flextensional transducer in cross section.

The flextensional transducer shown in FIG. 1 comprises a filament-wound GRP flexural shell 11 of an elliptical cylindrical form into which one or more piezo-electric stacks 12 are fitted along the major axis of the ellipse. Each stack 12 consists of a number of piezoelectric plates 13 between which are sandwiched metal electrodes 14 connected in parallel "D" section insert members 15 are provided to locate the ends of the stack 12.

The elliptical shell flextensional transducer is operated by applying an alternating voltage to the electrodes which causes vibrations to be generated in the directions along the piezo-electric stack. These vibrations are transmitted to the elliptical shell 11 and lead to increased amplitude vibrations in the directions on the minor axis of the shell. Conversely the transducer can be operated in a passive mode when pressure fluctuations in the surrounding medium lead to vibrations in the directions along the stack which in turn lead to an alternating output signal from the transducer electrodes 14.

During assembly of the transducer the shell is compressed along its minor axis by means of a press to an extent sufficient to allow insertion of the piezo-electric stacks and any shims necessary to achieve the correct stress in each stack of the assembled transducer.

Figure 2:
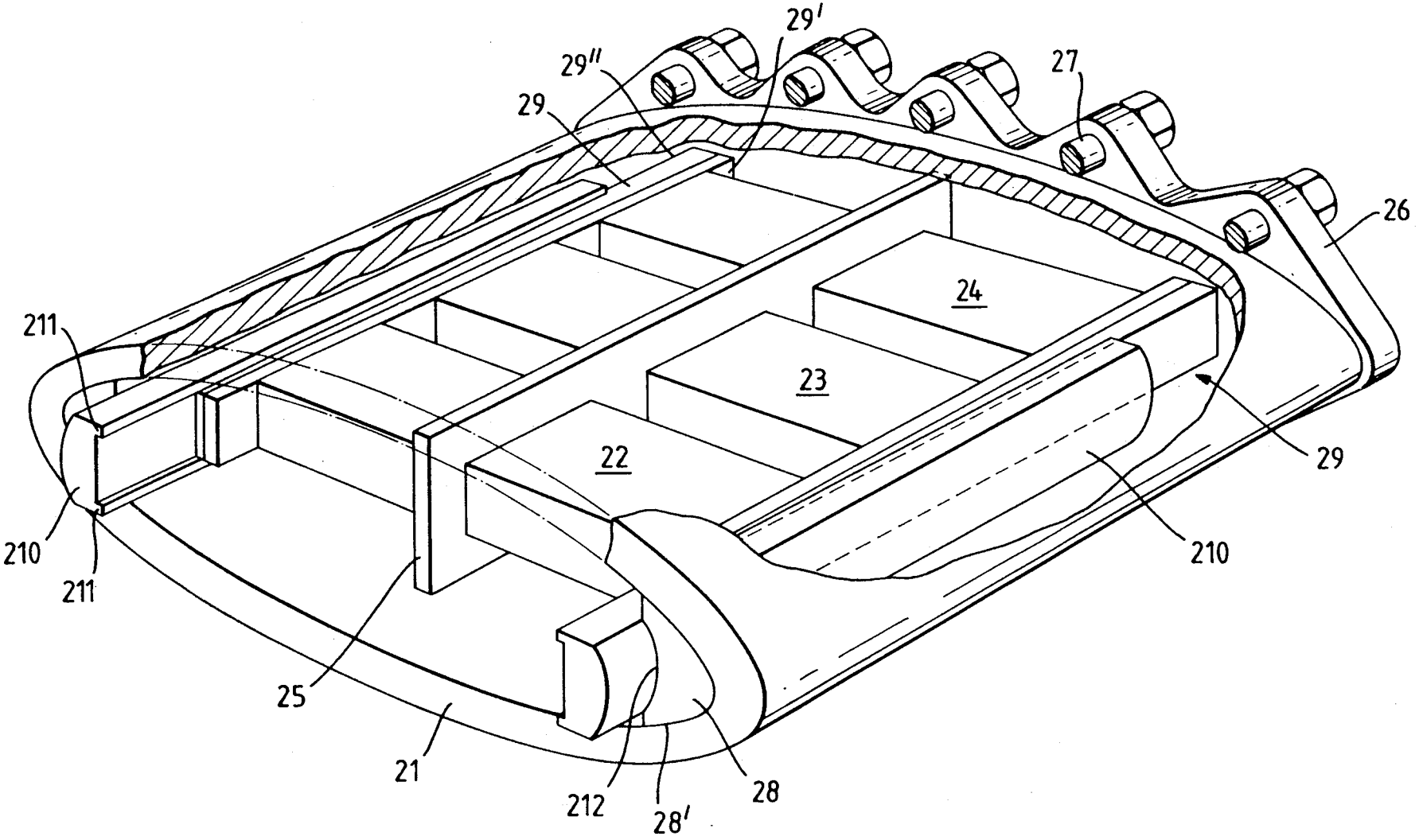
FIG. 2 shows a transducer according to the present invention.

FIG. 2 shows an elliptical shell flextensional transducer according to the invention, with one end plate removed for clarity. Supported within the elliptical GRP shell 21 are three piezo-electric stacks 22–24. A nodal plate 25 is attached to the nodal plane of the stacks 22–24 for support and also conduction of heat from the piezo-electric stacks to the end plates 26. The complete assembly is held in place by tie bars 27 which hold the end plates against the ends of the cylindrical shell 21 and provide a water-tight seal by compressing flexible seals, designed to permit vibrational movement of the shell as will be described later.

The cavity defined by the shell and end plates may be filled with a gas whose pressure is adjusted to the outside hydrostatic pressure as will also be described later.

At the opposite ends of the major axis of the ellipse there are provided shell inserts 28. The shell insert 28 has an outer cross section profile 28 formed to maintain the elliptical shape of the shell 21. Interposed between the shell insert 28 and the piezo-electric stacks are two complementary tapered wedges: a fixed wedge 29 and a sliding wedge 210, extending the length of the shell 21. The inner fixed wedge 29 is of composite structure having a uniform metallic inner portion 29 in contact with the adjacent ends of the stacks 22–24 and an outer low friction portion 29′ tapering lengthwise: being widest at the rear and narrowest at the front as shown. The complementary sliding wedge 210 also tapers lengthwise of the shell being widest at the face of the sliding wedge 210 and has raised lips which serve to locate the wedges to allow only lengthwise sliding. The outer face 212 of the sliding wedge 210 and the inner abutting face of the shell insert 28 are radiused so as to accurately locate the piezo-electric stacks.

During assembly the elliptical shell 21 is compressed by applying a press along its minor axis to extend the major axis while the piezo-electric stacks together with the nodal plate 25 and fixed wedges 29 are placed inside the shell. The sliding wedges 210, which are made larger than required, are then driven into position, the electrical charge from the piezo-electric stack being monitored to determine the required insertion lengths of the sliding wedges. The further the sliding wedges 210 are inserted, the greater the compressive force exerted along the stacks. The sliding wedges 210 are then removed, trimmed to length, and reinserted before removing the press and assembling the end plates 26.

Figure 3:
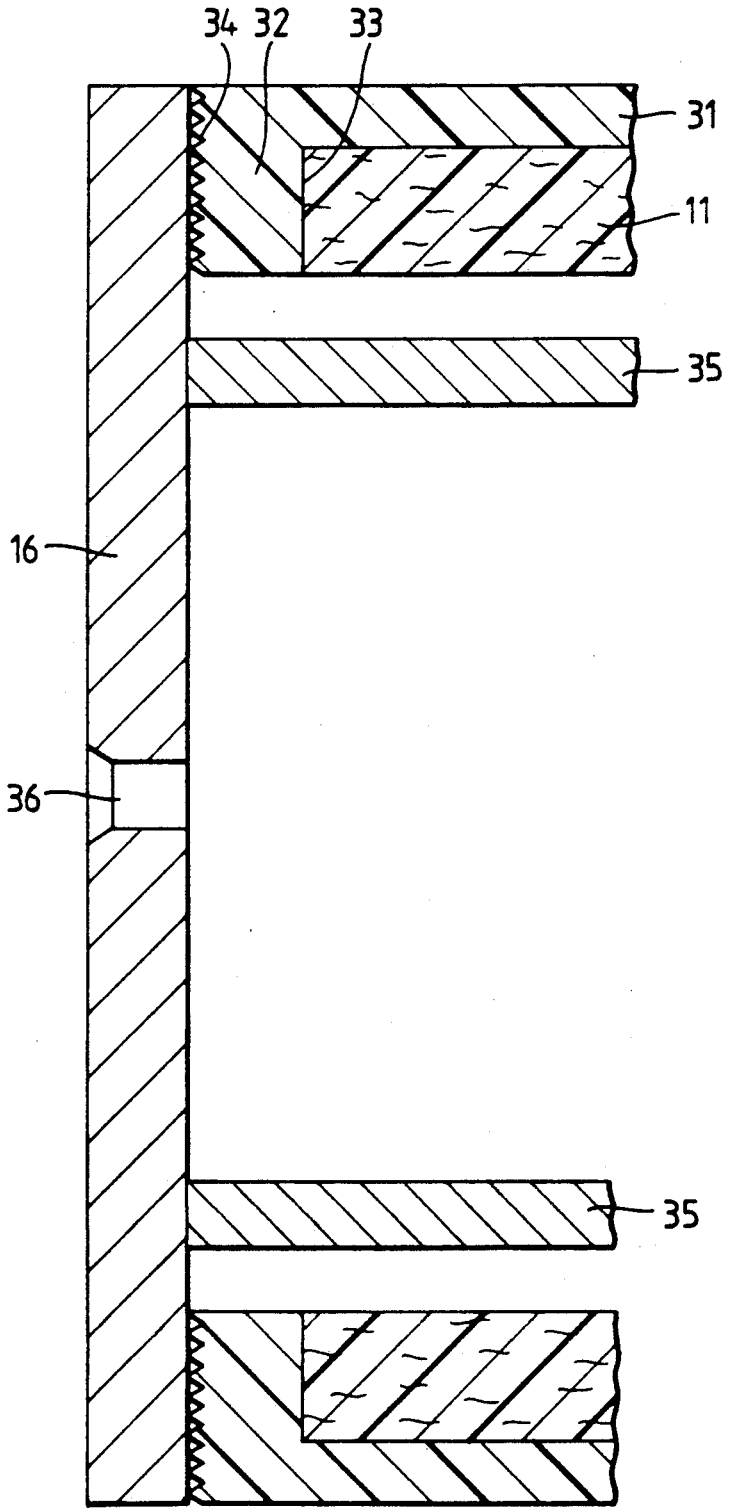
FIG. 3 is a cut-away view of a shell/end plate sealing arrangement.

FIG. 3 shows the sealing arrangement between the elliptical GRP shell 11 and one of the steel end plates 16. The shell 11 has a bonded neoprene coating 31 on its outer surface and integrally formed therewith is an end seal 32 bonded to the end face 33 of the shell 11. The end seal 32 is formed on its outer surface, adjacent to the steel end plate 16, with concentric serrations 34 running around the elliptical seal. A plurality of tie rods 35 are connected between the end faces and, on assembly of the transducer, the lengths of the tie rods are adjusted to determine the required compression of the end seal between the end plates and the shell. The degree of compression is determined by the depth of the serrations in the seal. Compressing the rubber reduces its shear modulus thereby enhancing acoustic decoupling. The overall thickness of the seal is determined by the peak magnitude of the shell vibration and the requirement to limit the sheer stress angle to 30 deg.

The neoprene coating 31 and lip seals 32 are compression bonded to the GRP shell 11 in the following way. After being treated with appropriate bonding preparations, the shell is placed on a support mandrel, enclosed in a steel mould, and the neoprene compression moulded and bonded to the shell in a heated platen hydraulic press. An opening 36 is provided for entry of an electrical cable to the transducer stacks.

The water integrity of the seal has been tested to a hydrostatic pressure of 2 MPa and dynamically tested at full power for 350 hours. In addition access to the inside of the transducer, for example, for replacing piezo-electric stack elements.

In an alternative arrangement the serrated lip seals could be compression bonded to the end plates 16 and the complete assembly then dip coated with a sealing agent, advantageously liquid neoprene.

Figure 4:
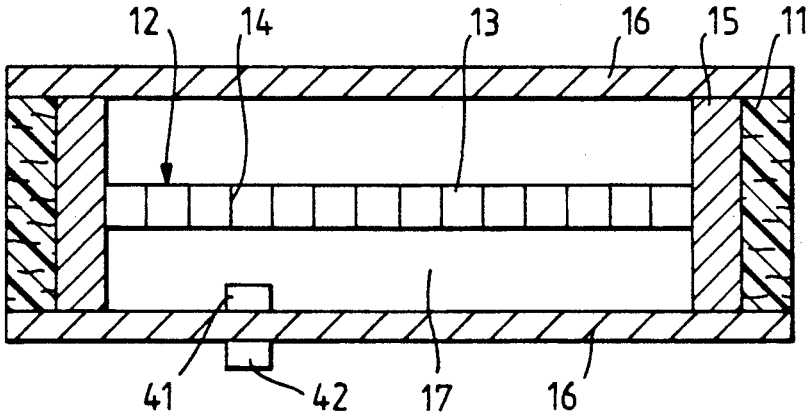
FIG. 4 is a modification of the FIG. 1 arrangement to provide depth compensation.

In the arrangement shown in FIG. 4 attached to one end plate 16 within the cavity 17 is a thermostatically controlled heater 41 controlled by a unit 42 outside the cavity. The unit 42 includes a pressure transducer for measuring the pressure of the ambient medium 40 and a control circuit to provide suitable temperature control signals to the thermostatic heater 41. Details of the unit 42 are not shown since they will be readily apparent to those experienced in this field.

Figure 5:
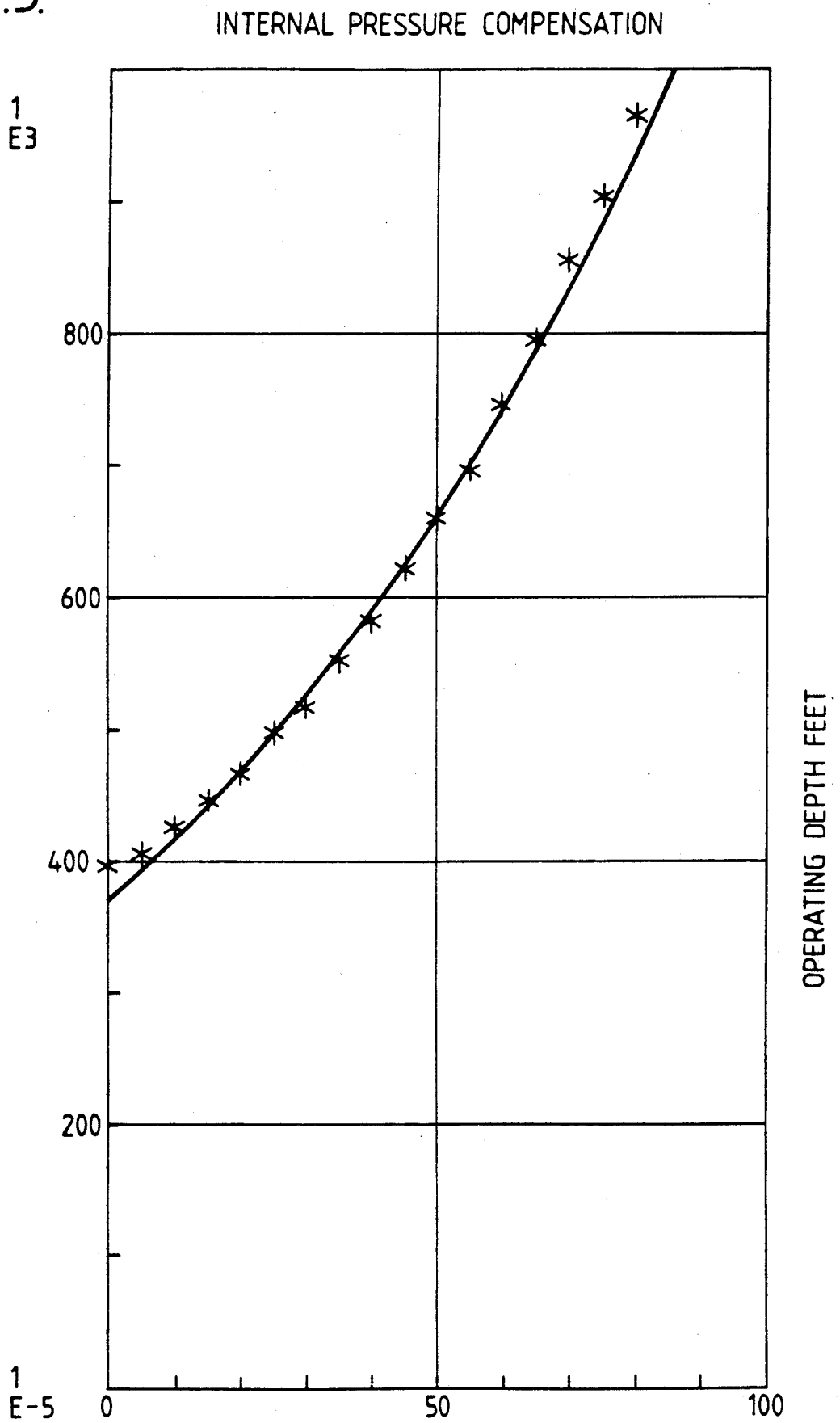
FIG. 5 shows the vapour pressure vs temperature characteristic of dichlorodifluoromethane.

FIG. 5 shows the variation with temperature of the vapour pressure of dichlorodifluoromethane measured in feet of water. The control circuit regulating the setting of the thermostatic heater 41 acting on the dichlorodifluoromethane is arranged to match the pressure within the cavity 17 to the hydrostatic pressure of the surrounding medium 40. By this means the tension in the flexural shell 11 is maintained substantially constant and the piezo-electric elements act under the same operating conditions throughout a wide range of pressure depths. Dichlorodifluoromethane has a relatively low vapour pressure at ambient temperatures and a vapour pressure of 250 PSIA at 65° C.

In addition to providing a relatively simple pressure compensating mechanism, the use of gases similar to dichlorodifluoromethane in place of the conventionally used air or nitrogen helps to control the dissipation of waste heat. Heat generated by the active elements of the transducer during high power operation can lead to thermal runaway under some operating conditions with air or nitrogen filled cavities. Although the thermal conductivity of dichlorodifluoromethane is less than air or nitrogen it has a higher heat capacity and lower gaseous viscosity leading to a higher heat transfer capability and improved heat dissipation capability when used in sonar transducers. This enables the transducer to operate at a higher power duty cycle or higher ambient temperature and hence greater operating depth without thermal runaway.

A further advantage results from the increased insulating effect with increased depth of the dichlorodifluoromethane and similar gases. In many conventional high power transducers the factor limiting the range of use is the breakdown voltage of the cavity medium at the applied electric field. Transducers filled with these gases generating relatively high internal depth compensation pressures could therefore be subjected to a greater electric field and hence generate more power.

As an alternative to filling the cavity 17 directly with gas a bladder filled with the gas may be provided inside the cavity 17. Thermostatic controlled heating of the gas would then be carried out inside the bladder. Alternatively the gas may be used to fill one section of a dual bladder inside the cavity of the transducer 17. The other section of the bladder would then be filled with seawater by providing a conduit connected to external seawater at ambient hydrostatic pressure.

Figure 6:
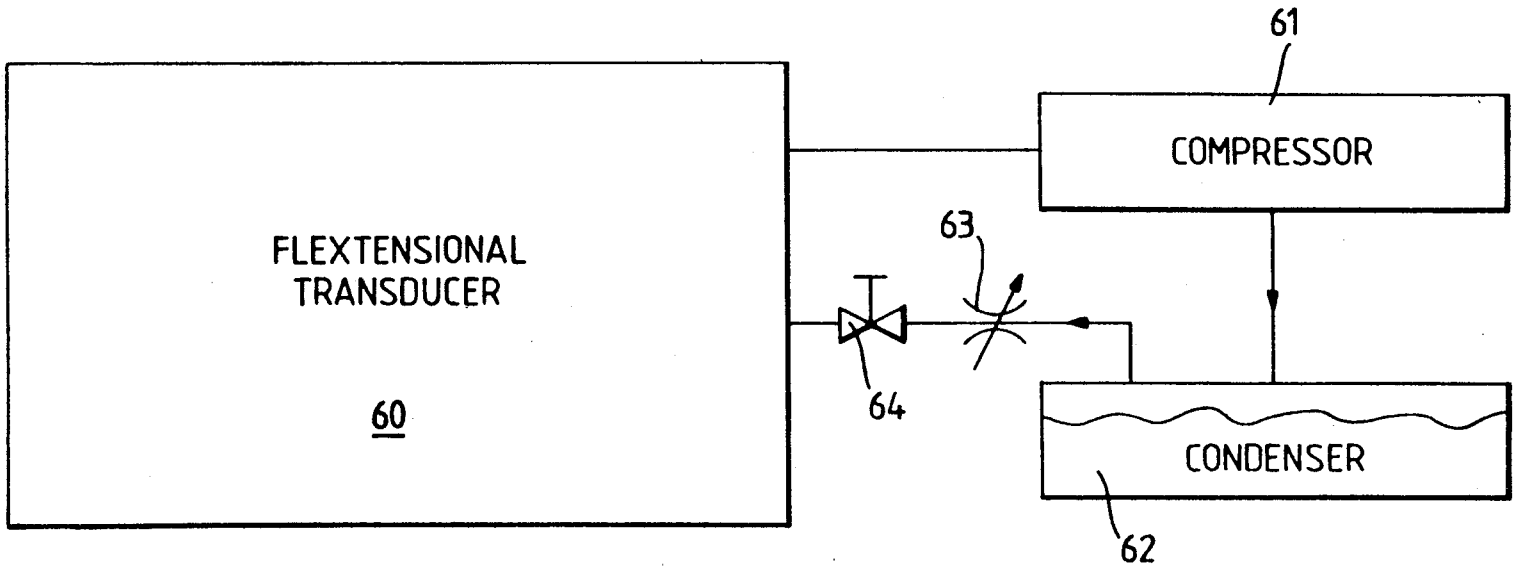
FIG. 6 shows an alternative vapour control mechanism for extending the depth capability of the transducer.

In an alternative arrangement closed or open cycle refrigeration systems may be coupled to the flextensional transducer to control the pressure of a refrigerant gas inside the transducer. A simplified system is illustrated in FIG. 6 wherein the interior of the flextensional transducer shell 60 included in a refrigeration loop including a compressor 61 and a condenser 62. A control system (not shown) would be required to start the compressor 61 when the pressure difference between the seawater and the refrigerant was lower than required, and to actuate the throttle valve 63 allowing vapour to enter the shell 60 from the condenser 62 in the converse situation. The condenser 62 thus acts as a refrigerant reservoir. A stop valve 64 is included in the line between the condenser 62 and the transducer 60. In order to operate with a refrigeration system the initial bias stress of the elliptical shell must be arranged such that the vapour pressure variation achieved by the refrigeration equipment maintains the bias stress on the piezo-electric stacks within design limits.

Figure 7:
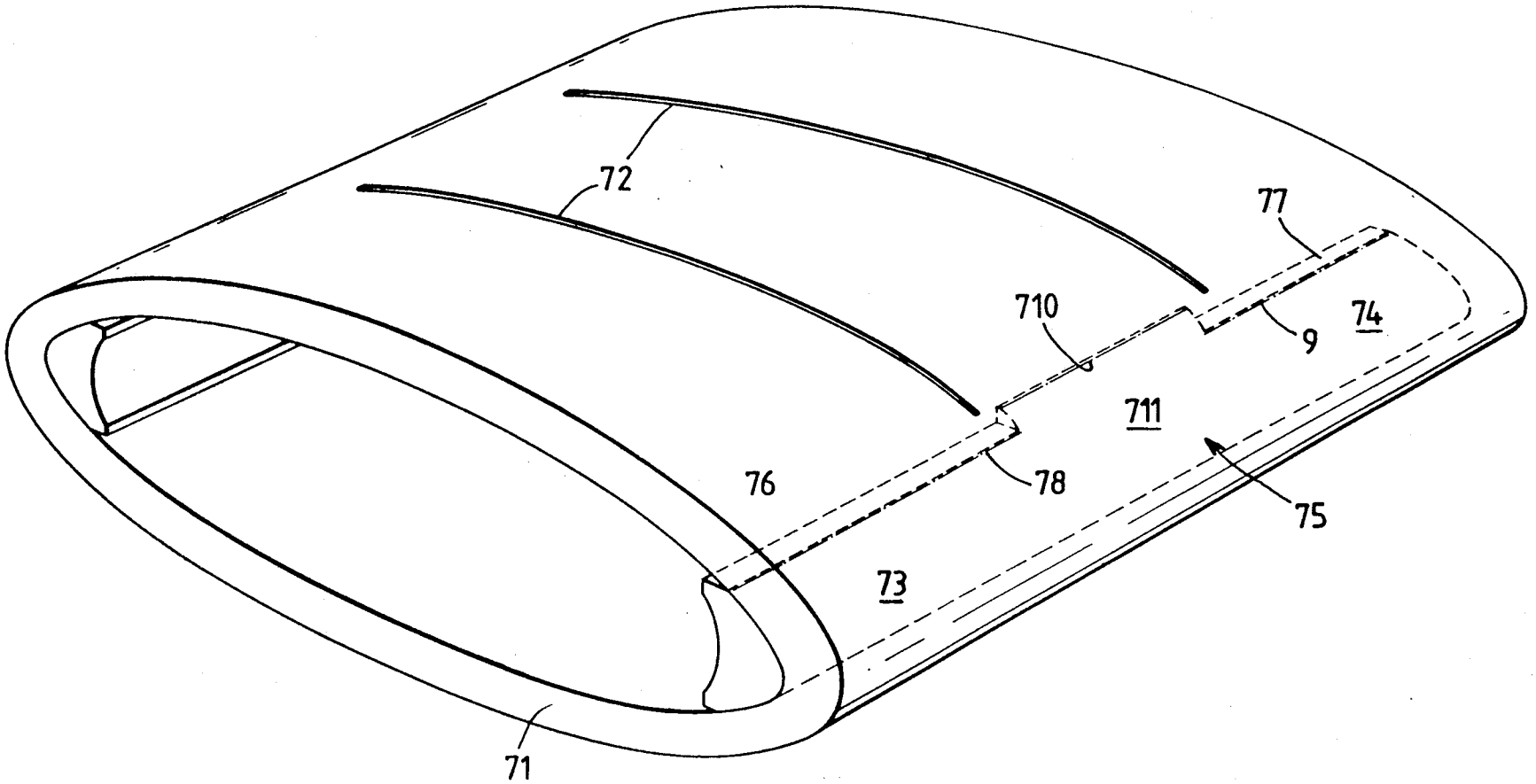
FIG. 7 is a perspective view of a further form of flextensional transducer.

FIG. 7 shows a flextensional transducer modified for broadband operation. The elliptical shell 71 is GRP as before but its outer surface is formed with two grooves 72 transverse to the shell length on the lower surface as well as the upper surface as shown. The outer portions 73 and 74 of the insert 75 have their edges 76, 77 cut away with the edges of the cut-away portions corresponding approximately to the positions of the shell grooves 72. The grooves 72 extend substantially as far as each fulcrum 78, 79 and may be formed by sawing substantially through the shell. As shown the cut-away edges 76, 77 result in the fulcra 78, 79 of the end portions 73, 74 of the shell being displaced from the fulcrum 710 of the centre portion 711 of the insert. The effective beam length of the centre portion of the shell 711 is thus less than the effective beam length for the outer portions of the shell. By segmenting the shell in providing the weakening grooves 72 each segment is partly decoupled from the adjacent segments and thus the beam can be made to vibrate at more than one fundamental flexural mode resonance on excitation by driving the piezo-electric stack 712 at these frequencies.

The number of segments can be larger than three and each segment could have a different effective beam length by appropriate forming of the inserts 75. Typical frequency variations of +/− 30% from a mean value of flexural resonance have been achieved with the present invention. The radiated power in each component can be predetermined. It has been found that this is related to the dimensions of the radiating surface and to the flexural resonant frequency. Thus the disposition of the segments can be arranged to enable the shape of the acoustic power frequency response to match a required characteristic. For example the segments can be arranged to reduce the peak power and widen the effective band-width.

Figure 8:
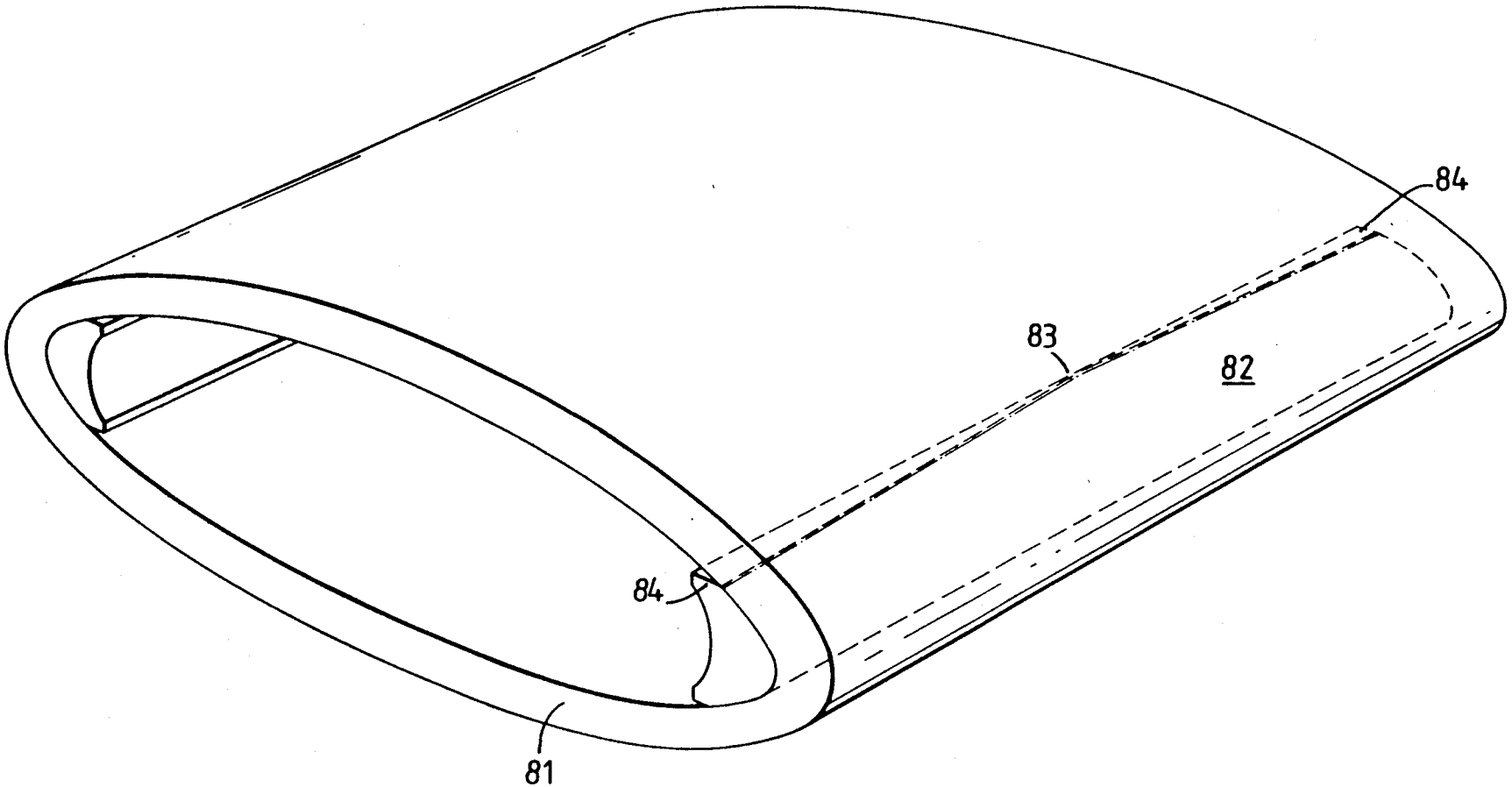
FIG. 8 is a perspective view of an alternative arrangement to FIG. 7.

FIG. 8 shows an alternative embodiment of the invention. In this form the elliptical shell 111 is uniform along its length without segmentation. In place of the stepwise change of profile of the insert as in FIG. 7 there is a gradual change along the length of the insert such that the effective beam length is a maximum at each end of the shell and a minimum at the centre. This is done by a gradual cut-away at the top and bottom edges of the insert 82 from zero at the center 83 to a maximum at the ends 84. With sufficient lateral decoupling in the GRP shell 81 there will be a consequential gradual change in flexural resonance along the length of the shell. Although the FIG. 8 arrangement is shown such that there is symmetry about the centre of the shell, other gradual changes of the effective beam length may be used as for example by gradually increasing the effective beam length throughout the length of the shell.

Modifications of this invention will be apparent to those skilled in the art, all falling within the scope of the invention defined herein.

We claim:

1. A flextensional transducer comprising:

a hollow cylindrical flexural shell, elliptical in cross section and open at both ends;

at least one linear stack of piezo-electric elements fitted along the major axis of the elliptical shell between the opposed internal walls of the shell;

two metal inserts located on at each end of the major axis between the shell wall and the corresponding end of the transducer stack and shaped in cross section to maintain the elliptical shape of the shell; and wedge-shaped portions interposed between each insert and the corresponding stack end.

2. A flextensional transducer as claimed in claim 1 wherein the abutting surfaces of each insert and the adjacent wedge-shaped portion are curved.

3. A flextensional transducer comprising:

a hollow cylindrical flexural shell, elliptical in cross section and open at both ends;

at lest one linear stack of piezo-electric elements fitted along the major axis of the elliptical shell between the opposed internal walls of the shell;

two metal inserts located one at each end of the major axis between the shell wall and the corresponding end of the transducer stack and shaped in cross section to maintain the elliptical shape of the shell; and wedge-shaped portions interposed between each insert and the corresponding stack end wherein said transducer includes end plates at either end of said shell, and there is provided a sealing member for sealing between the end plates and the flexural shell, the sealing member being a low shear modulus rubber vulcanised moulded to the outer surface of the flexural shell to form a continuous outer coating with integral lip seals on the end surfaces of the shell.

4. A flextensional transducer comprising:

a hollow cylindrical flexural shell, elliptical in cross section and open at both ends;

at least one linear stack of piezo-electric elements fitted along the major axis of the elliptical shell between the opposed internal walls of the shell;

two metal inserts located one at each end of the major axis between the shell wall and the corresponding end of the transducer stack and shaped in cross section to maintain the elliptical shape of the shell; and wedge-shaped portions interposed between each insert and the corresponding stack end wherein said transducer includes end plates at either end of said shell, and there is provided a sealing member for sealing between the end plates and the flexural shell, the sealing member being a low shear modulus rubber vulcanised moulded to the inner surface of each end plate to form a coating with an integral seal around the periphery of the end plate.

5. A flextensional transducer as claimed in claim 3 wherein the rubber is neoprene rubber and is provided with a plurality of concentric elliptical serrations (34) on the outer surface of the lip seal for contact with the corresponding transducer member.

6. A flextensional transducer as claimed in claim 4 wherein each of said end plates is compressed against said shell, and wherein the degree of compression of the lip seal between the shell and the lip is between 10% and 30%.

7. A flextensional transducer as claimed in claim 4 wherein said seal includes a sheer stress angle and the thickness of the seal is such that the sheer stress angle is limited to 30 deg.

8. A flextensional transducer as claimed in claim 3 wherein a plurality of tie bars (27) is fixed between the two end plates and located inside or outside the shell to determine the compression of the lip seals.

9. A flextensional transducer comprising:

a hollow cylindrical flexural shell, elliptical in cross section and open at both ends;

at least one linear stack of piezo-electric elements fitted along the major axis of the elliptical shell between the opposed internal walls of the shell;

two metal inserts located one at each end of the major axis between the shell wall and the corresponding end of the transducer stack and shaped in cross section to maintain the elliptical shape of the shell; and wedge-shaped potions interposed between each insert and the corresponding stack end wherein there is provided a pressure compensation means comprising:

a cavity defined by the shell of the flextensional transducer and a pair of end closure plates;

a gas contained in the cavity;

means to vary the temperature of the gas;

a depth pressure sensor; and a control circuit means, responsive to the depth pressure sensor and the temperature varying means for controlling the temperature of the gas such that the gas vapour pressure acting on the inner side of the shell is substantially the same as the depth pressure.

10. A flextensional transducer as claimed in claim 9 wherein the temperature varying means is a heating element.

11. A flextensional transducer as claimed in claim 9 wherein the gas fills the cavity.

12. A flextensional transducer as claimed in claim 9 wherein the gas fills a bladder within the cavity.

13. A flextensional transducer as claimed in claim 9 wherein the cavity contains a dual bladder, the gas filling one section of the bladder and seawater the other section; the bladder being arranged in such a way that the gas is compressed by the external ambient hydrostatic pressure.

14. A flextensional transducer as claimed in claim 9 wherein the gas is dichlorodifluoromethane.

15. A flextensional transducer as claimed in claim 2 wherein the two inserts are formed such that an arcuate length of each insert surface in contact with the shell wall changes along the length of the shell cylinder.

16. A flextensional transducer as claimed in claim 15 wherein there are one or more discrete length changes of the arcuate surface of each insert.

17. A flextensional transducer as claimed in claim 16 wherein the shell is segmented along its length with weakened regions corresponding to the positions of changing cross section of the inserts.

18. A flextensional transducer as claimed in claim 15 wherein the shell is uniform along its length and an arcuate profile of each insert cross section is progressively changed along at least a portion of the length of the shell.

19. A flextensional transducer as claimed in claim 18 wherein there is provided a pressure compensation means comprising:

a cavity defined by the shell of the flextensional transducer and a pair of closure end plates;

a gas contained in the cavity;

means to vary the temperature of the gas;

a depth pressure sensor; and a control circuit means, responsive to the depth pressure sensor and the temperature varying means, for controlling the temperature of the gas such that the gas vapour pressure acting on the inner side of the shell is substantially the same as the depth pressure.

20. A flextensional transducer as claimed in claim 19 wherein the gas fills a bladder within the cavity.

21. A flextensional transducer as claimed in claim 20 wherein the gas is dichlorodifluoromethane.

22. A flextensional transducer as claimed in claim 1 wherein there is provided a pressure compensation means comprising:

a cavity defined by the shell of the flextensional transducer and a pair of closure end plates;

a gas contained in the cavity;

means to vary the temperature of the gas;

a depth pressure sensor; and a control circuit means responsive to the depth pressure sensor and the temperature varying means, for controlling the temperature of the gas such that the gas vapour pressure acting on the inner side of the shell is substantially the same as the depth pressure.

23. A flextensional transducer as claimed in claim 22 wherein the temperature varying means is a heating element.

24. A flextensional transducer as claimed in claim 23 wherein the gas fills a bladder within the cavity.

25. A flextensional transducer as claimed in claim 24 wherein the gas is dichlorodifuloromethane.

* * * * *